US011359780B1

(12) United States Patent
Hsu

(10) Patent No.: US 11,359,780 B1
(45) Date of Patent: Jun. 14, 2022

(54) CEILING LAMP BRACKET ASSEMBLY WITHOUT USING SCREWS

(71) Applicant: Dong Guan Jia Sheng Lighting Technology Co., Ltd. China, Dong-Guna (CN)

(72) Inventor: Kevin Hsu, Taichung (TW)

(73) Assignee: Dong Guan Jia Sheng Lighting Technology Co., Ltd. China, Guang-Dong (CN)

( * ) Notice: Subject to any disclaimer, the term of this patent is extended or adjusted under 35 U.S.C. 154(b) by 0 days.

(21) Appl. No.: 17/394,573

(22) Filed: Aug. 5, 2021

(51) Int. Cl.

| | |
|---|---|
| ***F21S 8/04*** | (2006.01) |
| ***F21V 21/08*** | (2006.01) |
| ***F21V 21/088*** | (2006.01) |
| ***F21V 21/02*** | (2006.01) |

(52) U.S. Cl.
CPC ..... *F21S 8/043* (2013.01); *F21V 21/02* (2013.01); *F21V 21/08* (2013.01); *F21V 21/088* (2013.01); *F21V 21/0832* (2013.01)

(58) Field of Classification Search
CPC ..... F21S 8/043; F21V 21/088; F21V 21/08; F21V 21/00; F21V 21/02
USPC ..... 362/147, 396, 404
See application file for complete search history.

(56) References Cited

U.S. PATENT DOCUMENTS

| | | | | |
|---|---|---|---|---|
| 9,903,548 | B2 * | 2/2018 | Creasman | G08G 1/095 |
| 10,168,029 | B1 * | 1/2019 | Hsu | F21S 8/043 |
| 2018/0202637 | A1 * | 7/2018 | Sieczkowski | F21S 8/036 |
| 2021/0010660 | A1 * | 1/2021 | Hsu | F21S 8/04 |
| 2021/0088203 | A1 * | 3/2021 | Feit | F21S 8/061 |
| 2021/0262625 | A1 * | 8/2021 | Peng | F21S 8/03 |

FOREIGN PATENT DOCUMENTS

| | | | | |
|---|---|---|---|---|
| CN | 109163264 | * | 1/2019 | |
| CN | 110145707 | * | 8/2019 | |
| EP | 2916065 | A1 * | 9/2015 | F21V 21/02 |

* cited by examiner

*Primary Examiner* — Laura K Tso
(74) *Attorney, Agent, or Firm* — Karin L. Williams; Alan D. Kamrath; Mayer & Williams PC

(57) ABSTRACT

A mounting bracket for a ceiling lamp includes a support frame and a lamp bracket body removably mounted on the support frame. The support frame includes a frame body, a locking hook mounted on a first side of the frame body, and a limit locking plate mounted on a second side of the frame body. The limit locking plate includes a fixed portion secured to the frame body, a connecting portion connected with the fixed portion, a limit portion connected with the connecting portion, and a locking portion connected with the limit portion. The lamp bracket body has a first side provided with a first function portion and a second side provided with a second function portion. In assembly, the locking hook is mounted on the first function portion, and the limit locking plate is mounted on the second function portion.

8 Claims, 4 Drawing Sheets

CEILING LAMP BRACKET ASSEMBLY WITHOUT USING SCREWS

BACKGROUND OF THE INVENTION

1. Field of the Invention

The present invention relates to a ceiling lamp or light and, more particularly, to a mounting bracket for a ceiling lamp.

2. Description of the Related Art

A conventional ceiling light comprises a wall bracket secured to the ceiling and a lamp body secured to the wall bracket. The wall bracket has a first end provided with a hook for hooking a first side of the lamp body and a second end provided with screws for securing a second side of the lamp body. However, the lamp body is mounted on the wall bracket by the screws, thereby causing inconvenience to the user in assembling and disassembling the conventional ceiling light at a height. In addition, the user cannot mount the lamp body on the wall bracket when the screw are missed, thereby causing inconvenience to the user. Further, the screws are easily dropped during a period of time, thereby causing danger to the user.

BRIEF SUMMARY OF THE INVENTION

The primary objective of the present invention is to provide a mounting bracket for a ceiling lamp without using screws.

In accordance with the present invention, there is provided a mounting bracket comprising a support frame and a lamp bracket body removably mounted on the support frame. The support frame includes a frame body, a locking hook mounted on a first side of the frame body, and a limit locking plate mounted on a second side of the frame body. The locking hook has an upper end secured to the frame body. The locking hook has a lower end bent outward and upward. The limit locking plate includes a fixed portion, a connecting portion, a limit portion, and a locking portion. The fixed portion is secured to the frame body. The connecting portion is connected with the fixed portion. The limit portion is mounted on a bottom of the connecting portion. The limit portion has a first end connected with the connecting portion. The limit portion has a second end extending downward and outward and inclined toward a direction distant from the fixed portion. The locking portion is connected with the first end of the limit portion and located adjacent to the connecting portion. The lamp bracket body has a first side provided with a first function portion and a second side provided with a second function portion. The locking hook is mounted on and secured to the first function portion, and the limit locking plate is mounted on and secured to the second function portion.

According to the primary advantage of the present invention, the mounting bracket is assembled and disassembled easily and conveniently without using screws, thereby greatly facilitating the user assembling and disassembling the mounting bracket.

According to another advantage of the present invention, the lamp bracket body is mounted on or removed from the support frame easily and quickly to simplify the assembling and disassembling procedure of the mounting bracket.

According to a further advantage of the present invention, the mounting bracket does not need screws to prevent danger caused by falling or loosening of screws.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
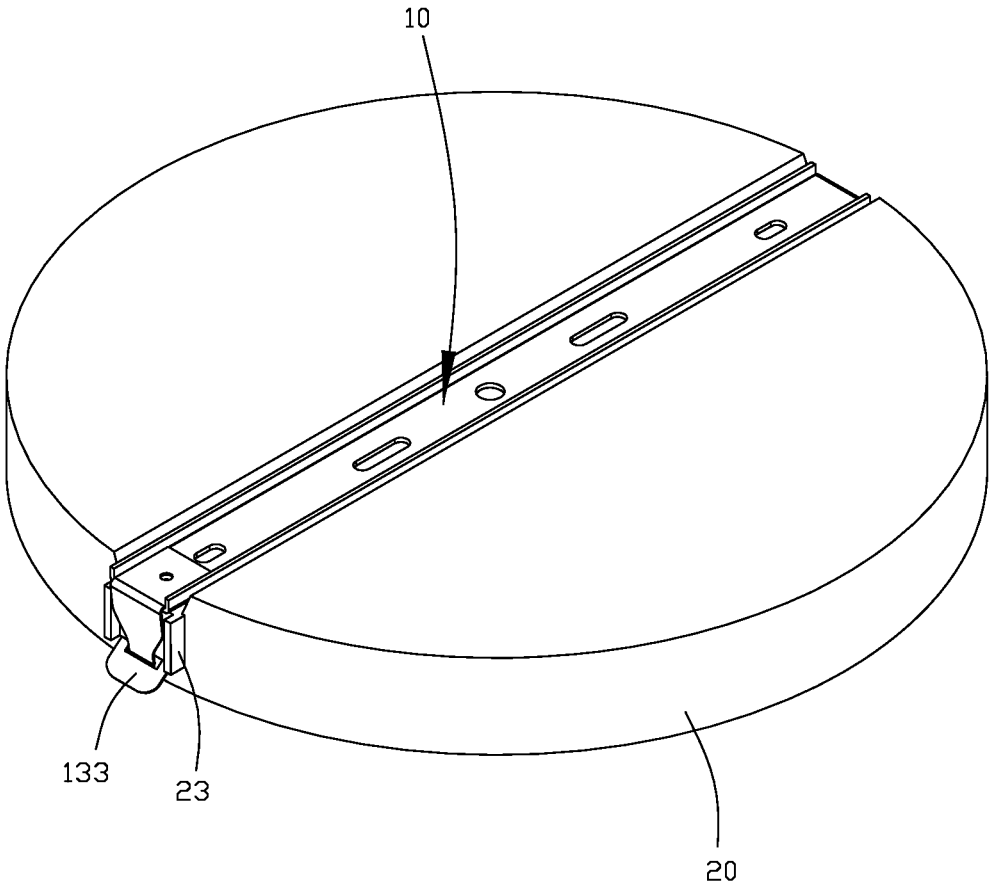
FIG. 1 is a perspective view of a mounting bracket in accordance with the preferred embodiment of the present invention.
Figure 2:
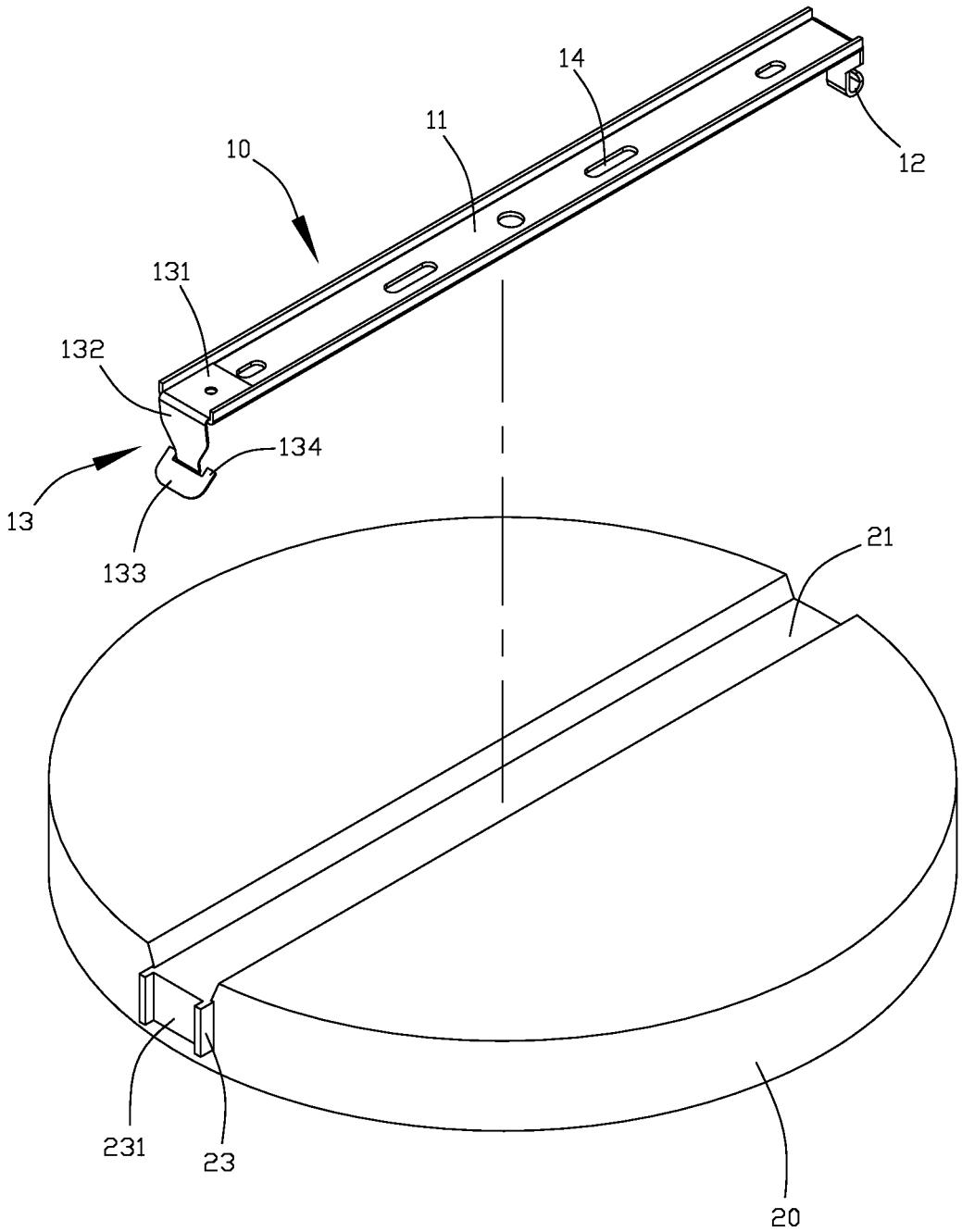
FIG. 2 is an exploded perspective view of the mounting bracket in accordance with the preferred embodiment of the present invention.
Figure 3:
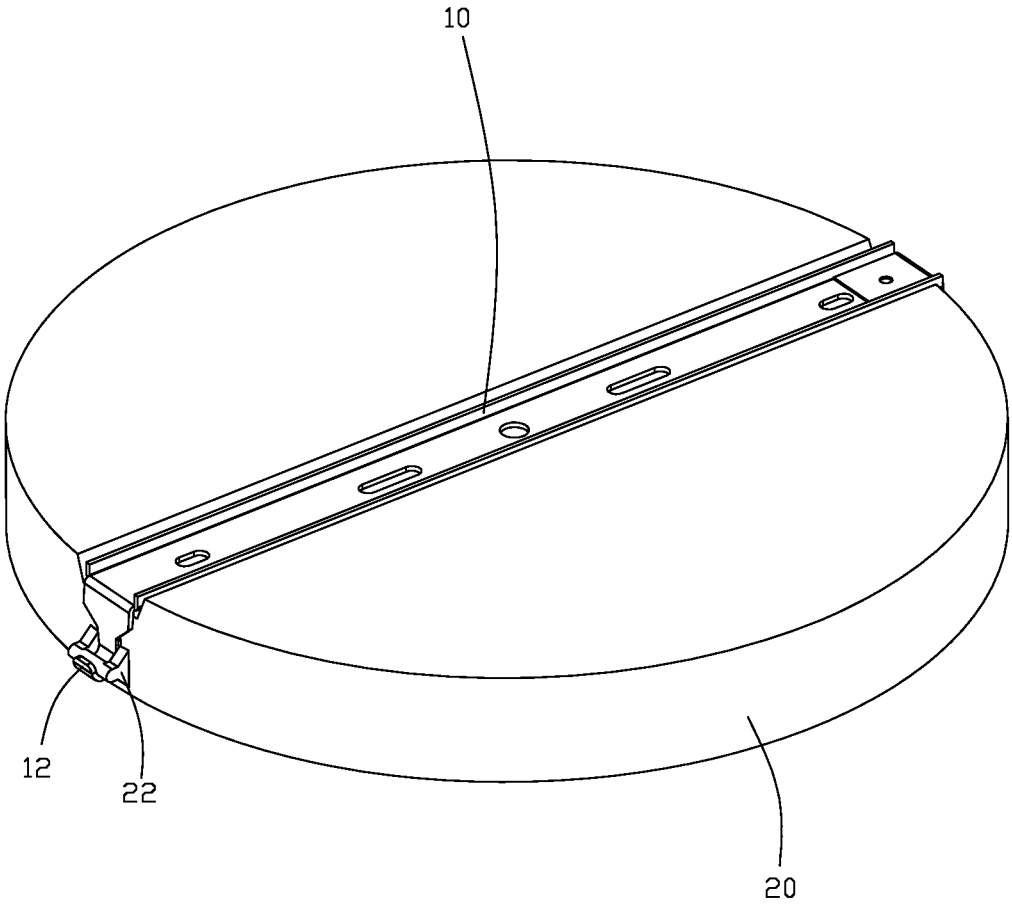
FIG. 3 is another perspective view of the mounting bracket in accordance with the preferred embodiment of the present invention.
Figure 4:
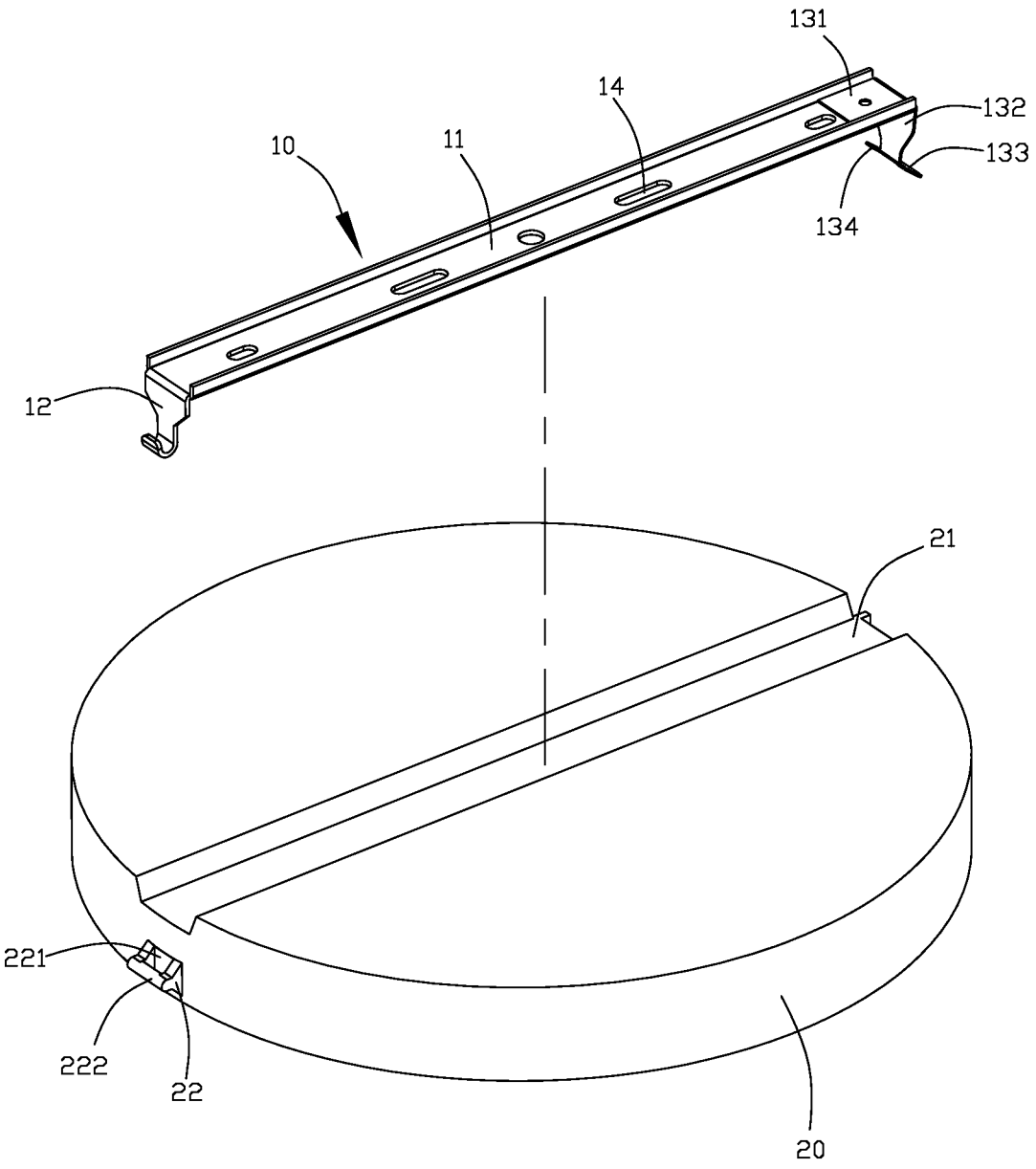
FIG. 4 is an another exploded perspective view of the mounting bracket in accordance with the preferred embodiment of the present invention.

Referring to FIGS. 1-4, a mounting bracket for a ceiling lamp in accordance with the preferred embodiment of the present invention comprises a support frame 10 and a lamp bracket body 20 removably mounted on the support frame 10.

The support frame 10 is mounted on a ceiling or a wall. The support frame 10 includes a frame body 11, a locking hook 12 mounted on a first side of the frame body 11, and a limit locking plate 13 mounted on a second side of the frame body 11.

The locking hook 12 has an upper end secured to the frame body 11. The locking hook 12 has a lower end bent outward and upward.

The limit locking plate 13 includes a fixed portion 131, a connecting portion 132, a limit portion 133, and a locking portion 134. The fixed portion 131 is secured to the frame body 11. The connecting portion 132 is connected with the fixed portion 131 and extends downward from the fixed portion 131. The limit portion 133 is mounted on a bottom of the connecting portion 132. The limit portion 133 has a first end connected with the connecting portion 132. The limit portion 133 has a second end extending downward and outward and inclined toward a direction distant from the fixed portion 131. The locking portion 134 is connected with the first end of the limit portion 133 and located adjacent to the connecting portion 132. The locking portion 134 and the limit portion 133 are arranged on two opposite sides of the connecting portion 132.

The lamp bracket body 20 has a first side provided with a first function portion 22 and a second side provided with a second function portion 23. In assembly, the locking hook 12 is mounted on and secured to the first function portion 22, and the limit locking plate 13 is mounted on and secured to the second function portion 23.

In the preferred embodiment of the present invention, the lamp bracket body 20 has a circular shape and has a top provided with a mounting channel 21. The mounting channel 21 extends through a whole diameter of the lamp bracket body 20.

In the preferred embodiment of the present invention, the first function portion 22 and the second function portion 23 are arranged at two opposite ends of the mounting channel 21.

In the preferred embodiment of the present invention, the frame body 11 is provided with a plurality of mounting slots 14. Each of the mounting slots 14 extends vertically through a whole thickness of the frame body 11.

In the preferred embodiment of the present invention, the locking portion 134 is in line with the limit portion 133. The locking portion 134 extends in a direction corresponding to that of the limit portion 133.

In the preferred embodiment of the present invention, the first function portion 22 is provided with a first retaining groove 221 and a retaining shaft 222. The retaining shaft 222 is arranged in the first retaining groove 221. The second function portion 23 is provided with a second retaining groove 231.

In the preferred embodiment of the present invention, the second retaining groove 231 vertically extends through a whole height of the second function portion 23.

In the preferred embodiment of the present invention, the fixed portion 131 has an end bent downward and forming the connecting portion 132.

In the preferred embodiment of the present invention, the frame body 11 and the locking hook 12 are formed integrally.

In the preferred embodiment of the present invention, the limit locking plate 13 is secured to the frame body 11 by fasteners.

In another preferred embodiment of the present invention, the frame body 11 and the limit locking plate 13 are formed integrally.

In the preferred embodiment of the present invention, the limit locking plate 13 is made of an elastic metal.

In assembly, when the lamp bracket body 20 is to be mounted on the support frame 10, the first function portion 22 of the lamp bracket body 20 is secured on the locking hook 12 of the support frame 10, with the bottom of the locking hook 12 passing through the first retaining groove 221 and hooked on the retaining shaft 222, so that the first function portion 22 of the lamp bracket body 20 is retained by the locking hook 12 of the support frame 10. Then, the second function portion 23 of the lamp bracket body 20 is pushed toward the limit locking plate 13 of the support frame 10, with the locking portion 134 of the limit locking plate 13 sliding through the second retaining groove 231 of the second function portion 23 and locked onto the bottom of the second function portion 23, so that the second function portion 23 of the lamp bracket body 20 is locked by the limit locking plate 13 of the support frame 10. Thus, the lamp bracket body 20 is mounted on and secured to the support frame 10.

On the contrary, when the lamp bracket body 20 is to be removed from the support frame 10, the limit portion 133 of the limit locking plate 13 is pushed outward, to detach the locking portion 134 of the limit locking plate 13 from the bottom of the second function portion 23, so that the second function portion 23 of the lamp bracket body 20 is unlocked from the limit locking plate 13 of the support frame 10. Then, the lamp bracket body 20 is pivoted about the retaining shaft 222. Then, the first function portion 22 of the lamp bracket body 20 is pushed upward to detach the locking hook 12 from the first retaining groove 221 and the retaining shaft 222, so that the first function portion 22 of the lamp bracket body 20 is unlocked and removed from the locking hook 12 of the support frame 10. Thus, the lamp bracket body 20 is removed from the support frame 10.

Accordingly, the mounting bracket is assembled and disassembled easily and conveniently without using screws, thereby greatly facilitating the user assembling and disassembling the mounting bracket. In addition, the lamp bracket body 20 is mounted on or removed from the support frame 10 easily and quickly to simplify the assembling and disassembling procedure of the mounting bracket. Further, the mounting bracket does not need screws to prevent danger caused by falling or loosening of screws.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A mounting bracket comprising:

a support frame; and a lamp bracket body removably mounted on the support frame;

wherein:

the support frame includes a frame body, a locking hook mounted on a first side of the frame body, and a limit locking plate mounted on a second side of the frame body;

the locking hook has an upper end secured to the frame body;

the locking hook has a lower end bent outward and upward;

the limit locking plate includes a fixed portion, a connecting portion, a limit portion, and a locking portion;

the fixed portion is secured to the frame body;

the connecting portion is connected with the fixed portion;

the limit portion is mounted on a bottom of the connecting portion;

the limit portion has a first end connected with the connecting portion;

the limit portion has a second end extending downward and outward and inclined toward a direction distant from the fixed portion;

the locking portion is connected with the first end of the limit portion and located adjacent to the connecting portion;

the lamp bracket body has a first side provided with a first function portion and a second side provided with a second function portion;

the locking hook is mounted on and secured to the first function portion; and the limit locking plate is mounted on and secured to the second function portion.

2. The mounting bracket as claimed in claim 1, wherein the lamp bracket body has a circular shape and has a top provided with a mounting channel, and the mounting channel extends through a whole diameter of the lamp bracket body.

3. The mounting bracket as claimed in claim 2, wherein the first function portion and the second function portion are arranged at two opposite ends of the mounting channel.

4. The mounting bracket as claimed in claim 1, wherein the frame body is provided with a plurality of mounting slots, and each of the mounting slots extends vertically through a whole thickness of the frame body.

5. The mounting bracket as claimed in claim 1, wherein the locking portion extends in a direction corresponding to that of the limit portion.

6. The mounting bracket as claimed in claim 1, wherein:

the first function portion is provided with a first retaining groove and a retaining shaft;

the retaining shaft is arranged in the first retaining groove; and the second function portion is provided with a second retaining groove.

7. The mounting bracket as claimed in claim 6, wherein the second retaining groove vertically extends through a whole height of the second function portion.

8. The mounting bracket as claimed in claim 1, wherein the fixed portion has an end bent downward and forming the connecting portion.

* * * * *